United States Patent [19]

Epstein et al.

[11] 4,015,391

[45] Apr. 5, 1977

[54] SIMULATED CEDAR SHAKE CONSTRUCTION

[75] Inventors: George Epstein, Akron; Robert E. Mollman, Chagrin Falls, both of Ohio

[73] Assignee: Alside, Inc., Akron, Ohio

[22] Filed: Feb. 13, 1973

[21] Appl. No.: 332,163

[52] U.S. Cl. ..... 52/520; 52/57; 52/278; 52/531; 52/539; 52/542; 52/543; 52/547; 52/555

[51] Int. Cl.[2] ..... E04D 1/26

[58] Field of Search ..... 52/520, 526, 521, 535, 52/557–559, 539, 549, 547, 543, 554, 555, 409, 531, 536, 542

[56] References Cited

UNITED STATES PATENTS

| | | | |
|---|---|---|---|
| 2,214,387 | 9/1940 | Snyder | 52/555 X |
| 2,501,221 | 3/1950 | Humble | 52/535 |
| 2,990,651 | 7/1961 | Chalmers | 52/316 X |
| 3,217,453 | 11/1965 | Medow | 52/539 X |
| 3,238,687 | 3/1966 | Tisbo | 52/520 |
| 3,303,620 | 2/1967 | Dawson et al. | 52/539 X |
| 3,312,031 | 4/1967 | Berg | 52/316 X |
| 3,417,531 | 12/1968 | Jones | 52/555 |
| 3,593,479 | 7/1971 | Hinds et al. | 52/531 X |
| 3,605,369 | 9/1971 | Merrill et al. | 52/316 X |
| 3,608,261 | 9/1971 | French et al. | 52/314 X |
| 3,686,813 | 8/1972 | Breitwieser | 52/549 X |
| 3,703,795 | 11/1972 | Mattes | 52/521 |
| 3,731,438 | 5/1973 | Kough | 52/555 X |
| 3,760,546 | 9/1973 | Martin et al. | 52/555 |

FOREIGN PATENTS OR APPLICATIONS

| | | | |
|---|---|---|---|
| 218,694 | 5/1961 | Austria | 52/521 |
| 1,511,886 | 12/1967 | France | 52/555 |
| 621,216 | 6/1961 | Italy | 52/520 |

OTHER PUBLICATIONS

Shakertown, 9 pages, Feb. 18. 1972.

*Primary Examiner*—Leslie A. Braun
*Attorney, Agent, or Firm*—Fidelman, Wolffe & Waldron

[57] ABSTRACT

A simulated cedar shake panel for walls or roofs having at least two courses of simulated shakes in relief therein, the shakes being in overlapped and underlapped relation with a varied butt line, and recessed underlaps between side-by-side shakes. Part of each underlap is recessed enough to contact the roof or wall surface and provide a multiplicity of support surfaces for the panel. A step provided in each underlap near the bottom thereof forms part of the shake simulation and also adds to the structural rigidity of the panel.

Tongue and groove side-to-side and top-to-bottom panel interlocks form part of the shake array simulation, so that the interlock structure is concealed and the desired non-uniform shake appearance enhanced.

A stackable corner member one shake high is provided, the corner member having a skirt element which interfits with the butt edges of overlapped panel shakes to take up gaps due to the random butt line.

An angled cap member is provided to finish off hips and ridges.

6 Claims, 25 Drawing Figures

4
4
7
7
8
8
9
9
11
12
13
13
14
16
17
18
19
20
21
21
22
22
22
23
23
23
24
25
25
25
25
26
27
27
27
27
27
27
31
31
33
33

FIG. 19
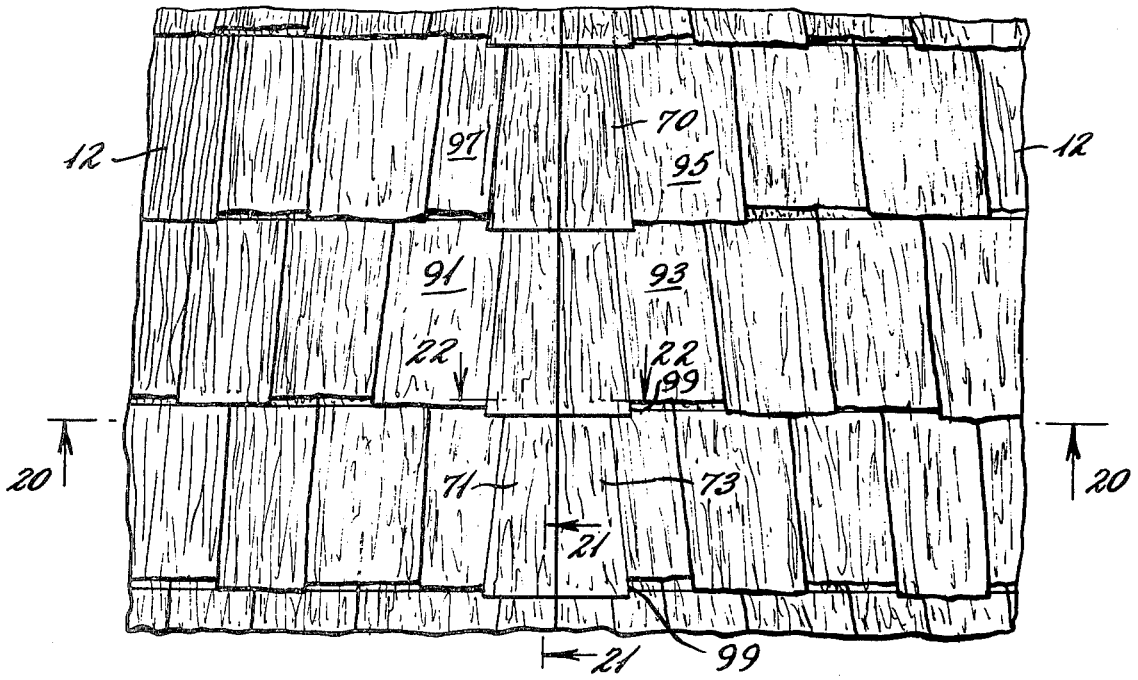
FIG. 20
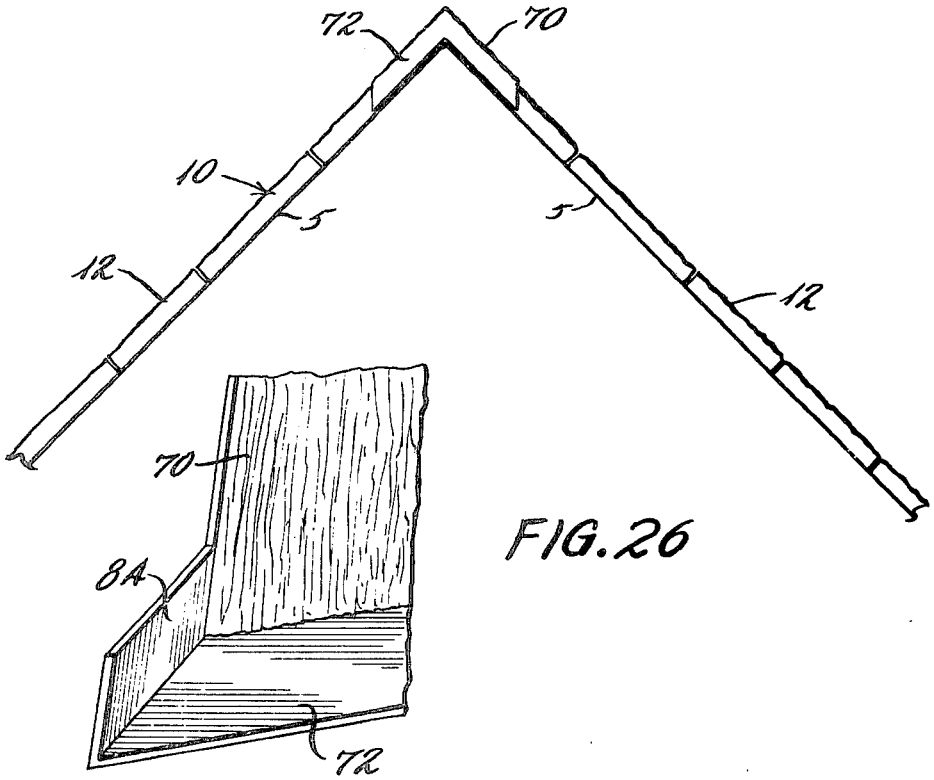
FIG. 26

FIG. 21
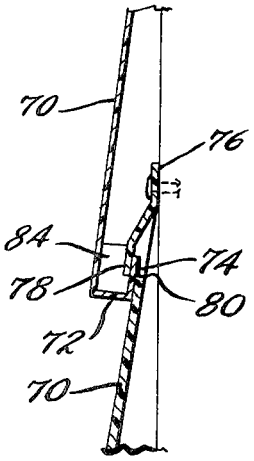
FIG. 22
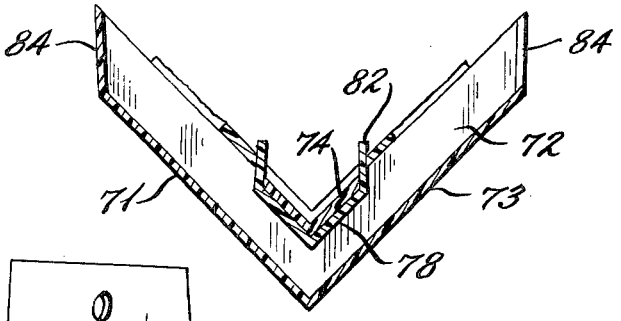
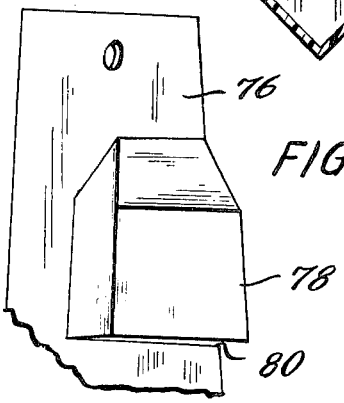
FIG. 25
FIG. 23
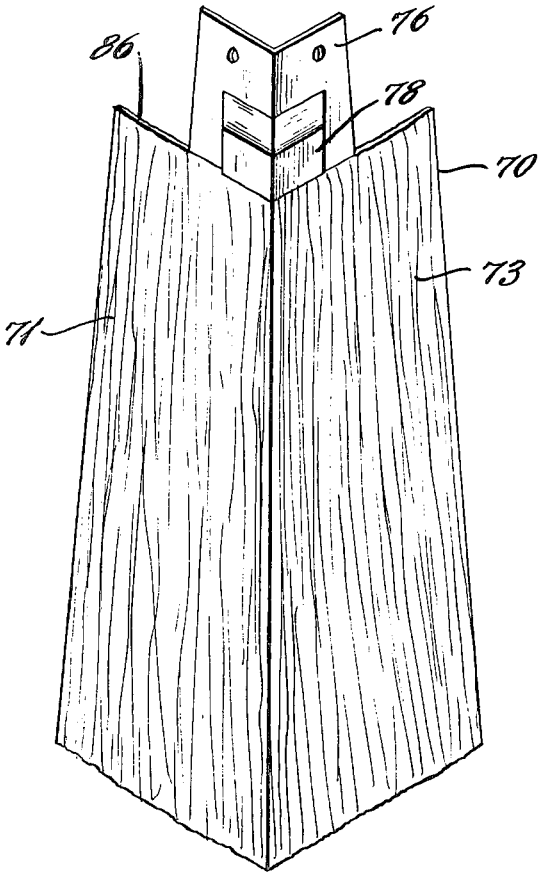
FIG. 24
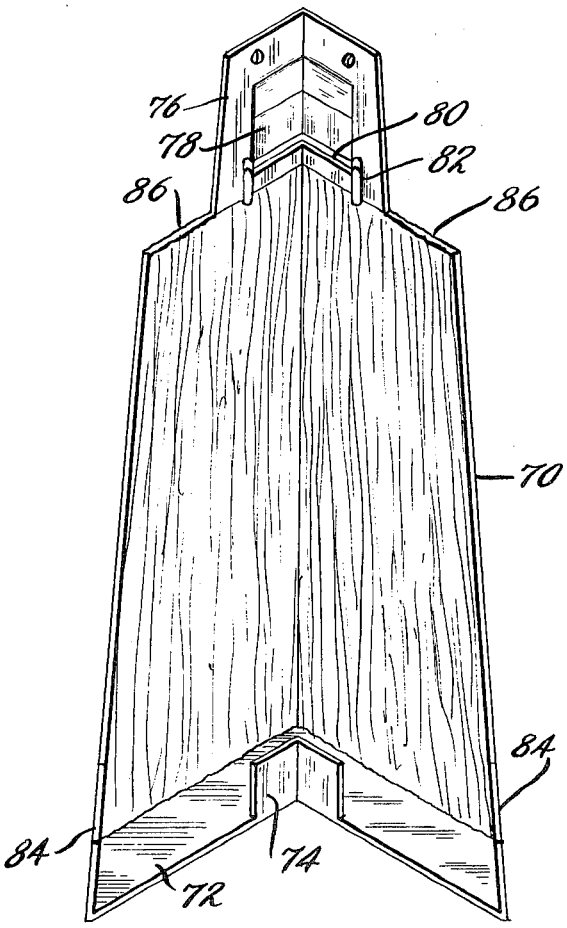

SIMULATED CEDAR SHAKE CONSTRUCTION

The present invention relates to construction involving a simulated wood shake roof and siding and in particular to simulated cedar shakes.

Wooden shakes are a well known and attractive material of construction. Cedar shakes in particular provide desirable material for siding and roofing, having been widely and extensively employed for many years. Unfortunately, although numerous householders would be delighted to side and/or roof their homes and businesses with cedar shakes, the truth of the matter is that the shakes are quite expensive and moreover require a great amount of expensive hand labor to install. This situation has given rise to a considerable body of art on simulated shakes made from metals (such as aluminum and galvanized steel), minerals (such as cement and asbestos compositions), even fiberglass laminates.

Unfortunately, the simulated shakes suggested heretofore to the art seem all to suffer from one or more undesirable attributes. Thus, for example, a simulated shake replicates the molding surface on which it is formed. No matter how closely the shake may resemble its natural counterpart, any roof or siding to which a multiplicity of individual simulated shakes are applied, evidences the repetitive identity of form and shape inherent in the replicated sameness of each simulated shake. The visual effect is quite different from the no-two-alike look of a natural shake roof or siding. A separate disadvantage inherent in individual simulated shakes is that the high labor costs involved in the shake-by-shake installation of a shake siding or roof has not been particularly avoided.

Installation labor costs can be substantially decreased by adoption of a panel expedient, namely a panel whose face has thereon a multiplicity of simulated shakes in a suitable assembled together configuration. The configuration in the panel face can be varied, shake to shake, and to that extent at least, the visual effect of shake-to-shake identity is avoided. However, a panel-to-panel identity exists and the need to conceal joints between adjacent panels becomes important. Indeed, some panel modes suggested to the art contemplate panel-to-panel joint configurations inconsistent with the highly individualized random appearance of true shake construction.

The present invention relates, in part, to a siding or roofing panel faced with simulated shakes. The simulated shake panel of the present invention retains, to a great degree, the visual non-regularity of cedar shakes without sacrificing the good construction practices and low labor costs possible with the shake panel expedient.

Briefly stated, the present invention involves a simulated shake panel suitable for siding and roofing and in addition, a simulated shake corner piece and simulated shake ridge caps which together can be employed to roof and face a building structure in simulated cedar shakes in an attractive non-repetitive simulated shake configuration.

The present simulated shake panel is a relatively elongated board long enough (e.g 5 feet) and high enough (e.g. 18 inches) to have what appears to be at least two courses of shakes on the face of the panel, with each course having therein a multiplicity of shakes (preferably more than five shakes). Thus the face of an exemplary panel appears to be an assembly of twenty highly individualized shakes disposed in two courses of ten shakes each. The simulated shakes, no two exactly alike, appear as they would be in true shake construction, some shakes overlapped and some shakes underlapped.

In one course, e.g. the upper shake course, the array of simulated shakes extends closer to the side edges of the panel, than in another course, e.g. the lower shake course. The end shakes in the lower course are spaced further from the side edge the distance of a shake-to-shake underlap. In consequence, when two panels are abutted side-edge to side-edge, the end shakes abut close enough to simulate a single split or cracked shake and the lower course simulates a shake-to-shake underlap. This cracked shake visual effect is enhanced if, as is contemplated, the end simulated shakes in the upper course are half-shake in size. On the lower course, simulated full size shakes are adjacent the side edges.

Desirably the side edge spacing difference between shake courses as described above is all at one side edge. At the other side edge, the shake ends may be in line, or very close to being in line. The course-to-course edge spacing difference described above should be about equal to the distance or spacing of a typical shake-to-shake underlap so that in the lower course, the joint of two panels abutted edge-to-edge creates a shake-to-shake underlap indistinguishable from the simulated shake-to-shake underlaps built into the panel face. The shake-to-shake underlap at one course, together with the cracked full shake effect of the other course, conceals the panel joint quite effectively.

True shake construction, with no-two-alike shakes nailed individually to the roof or side of the structure, requires that the building surface underlying the shakes be made reasonably weather-proof, desirably be free from air leaks and capable of withstanding water that is wind-driven under the shakes. For a structure so sound, the edges of the simulated shake panel might simply be finished off to simulate wood and be nailed to the structure like shakes, and such is contemplated. As compared to true shake construction, the relatively large size of such a simulated shake panel with its relatively few panel-to-panel joints constitutes an improvement over individual shake construction, because the large-sized panels inherently decrease reliance on the underlying structure to withstand air and water leakage.

It has been found, however, that sound structural practices (notably tongue and groove interfits) can be incorporated into the simulated shake panel of the present invention without disrupting the desired simulation of individual shakes. Certain panel edge configurations are contemplated as preferred modes of this invention, in part because the preferred edge configurations permit the array of simulated shakes on the panel to have a varied butt line.

A frequent feature of true shake construction is that the corner where two sides of the building structure intersect is frequently finished off by shakes. The simulated shake panel of the present invention can be employed with corner pieces simulative of true shake corners, and a preferred mode of corner piece is contemplated as part of the present invention. This corner piece permits compensation to be made for the butt line elevation differences built into the shake array on the panel face.

Still another common feature of true shake construction is that the ridges on roof peaks and hips are covered by individual shakes. The simulated shake panel of the present invention can be employed with a ridge or hip cap simulative of true shake construction and preferred simulated shake cap members are contemplated among the preferred modes of the present invention.

Also forming part of the present invention is a gable strip or trim member particularly adapted for use at the juncture of the simulated shake ridge cap and the simulated shake panels and at the exposed edges of the structure. The gable strip constitutes a rain trap for any rain wind-driven between the ridge cap and the simulated shake panel. The rain trap will help to effectively drain such water off the roof. The preferred gable strip member is of particular value for hip roof construction where considerable wind-driven rain might be forced into the juncture area between cap and the simulated shake panel.

For further understanding of the present invention, reference is now made to the attached drawings wherein:

FIG. 19 is a plan view of simulated shake corners and panels in assembled together form;

FIG. 20 is a section taken along line 20—20 of FIG. 19;

FIG. 21 is an enlarged fragmentary section taken along line 21—21 of FIG. 19;

FIG. 22 is an enlarged fragmentary section taken along line 22—22 of FIG. 19;

FIG. 23 is a front side perspective view of the corner member of the present invention;

FIG. 24 is a back side perspective view of the corner member of the present invention; and FIG. 25 is an enlarged fragmentary view of the corner to corner locking means;

FIG. 26 is an enlarged fragmentary perspective view of the corner member taken at a rear angle to the corner member.

Figure 1:
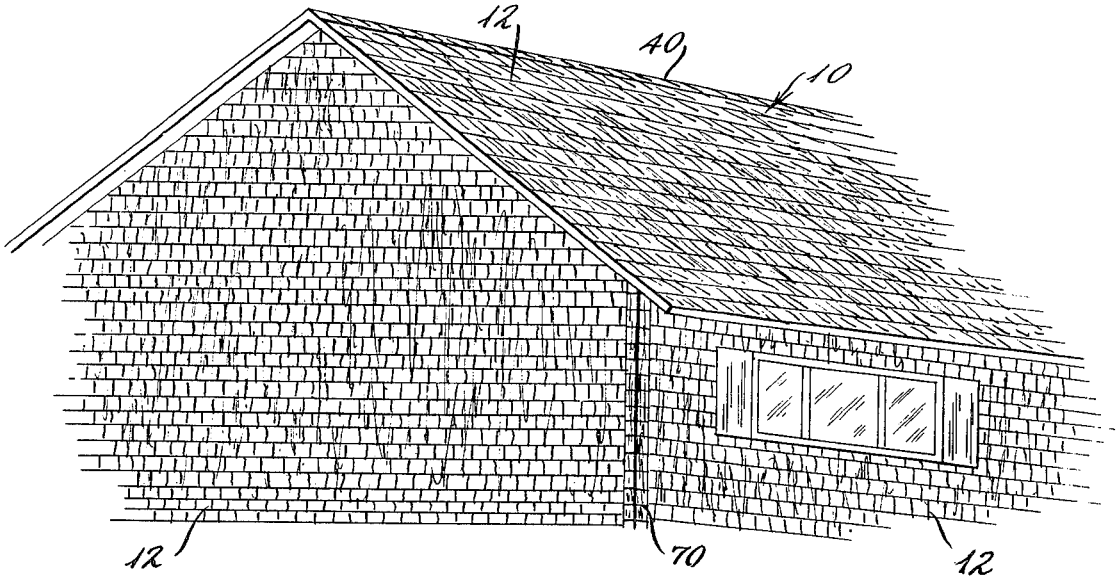
FIG. 1 is a perspective view of a structure faced and roofed by simulated shake panels, corners and ridge caps of the present invention.
Figure 2:
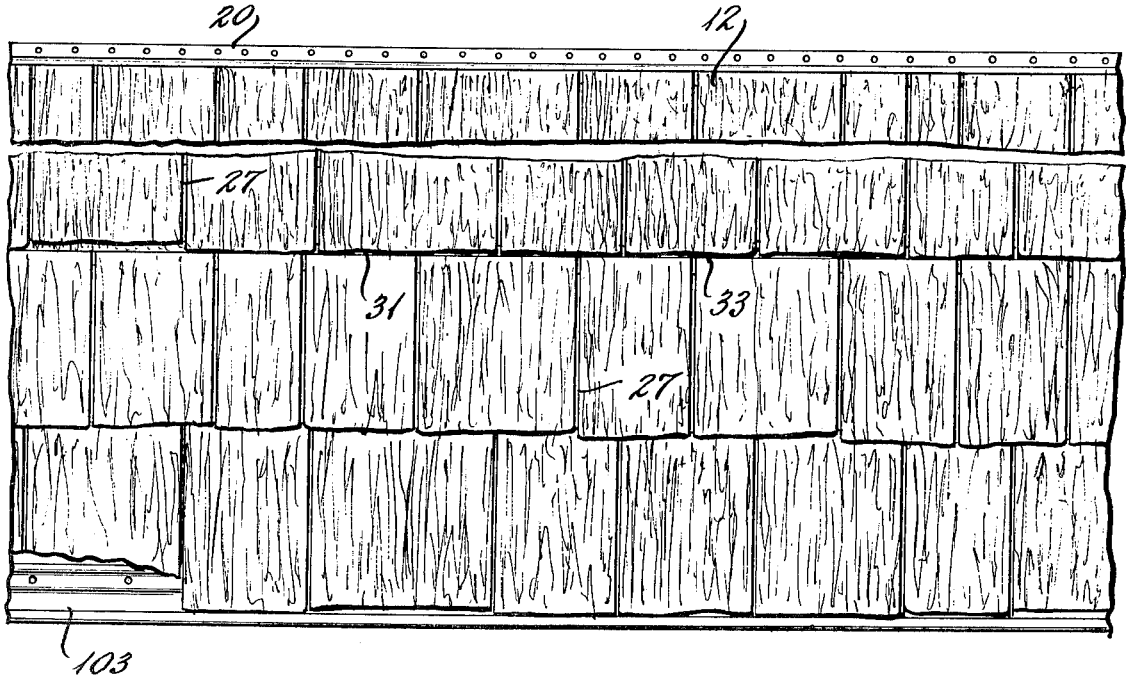
FIG. 2 is an enlarged fragmentary view of assembled simulated shake panels as used in the siding and roofing in FIG. 1.

As may be seen in the attached drawing, notably in FIGS. 1 and 2, the simulated shake panels of the present invention, in association with simulated shake corner members or pieces 70 and ridge caps 40, can be employed to roof or side a house 10 or other building structure. The individual panels 12,14,16 and 18 (FIG. 3) are made relatively large so that the human eye has difficulty identifying the symmetry which exists, panel to panel. In the preferred mode of panel illustrated in the drawing, two courses of shakes, e.g. 10 shakes in each course, are simulated on every panel face, with none of the simulated shakes exactly duplicated. Thus, in searching for repetitive identity, the human eye must somehow identify a twenty-shape multiple, as for example, discover that an unusual shake (size and position) like shake 21, has been exactly duplicated elsewhere in the repetitive pattern of a two-course, twenty-shake grouping repeated again and again.

For small areas, a four-corner panel interfit of panels 12,14,16,18 (as is illustrated for exemplary purposes in FIG. 3) may be used without upsetting the desired random shake simulation. However, for larger areas, the panels may be staggered course to course as has been illustrated in FIG. 1 and FIG. 10. The stagger makes identification of panel joints difficult. The eye sees only a random shake pattern. It may be noted, moreover, that practice of the present invention is not limited to panels from a single mold. Since panel dimensions and edge configuration are not related to the shake-to-shake simulation on the panel face, interchangeable panels may be formed with completely different shake configurations on the panel face. Accordingly, a structure faced and roofed in staggered panel course relationship might, if desired, be made with enough diverse panels to provide a complete random, no-two-alike shake array (provided, of course, enough panel molds were employed). The repetitive identify of the two course, twenty-shake configuration from a single panel face mode, is difficult to spot; a forty, sixty or eighty shake array are, of course, closer approaches to the completely random character of true shake construction, yet involve only two, three and four different panel face modes respectively.

Referring now to FIGS. 3, 4, 5 and 10, it may be seen that each panel, panel 12 for example, is bounded at the top longitudinal edge by a nailing strip 20, desirably pre-apertured for placement of nails therethrough. Nailing strip 20 forms the longer and rear leg of an upwardly open U-shaped channel 22. The short front leg 23 of channel 22 forms the top edge of the grained simulated shake facing of the panel 12. The bottom marginal edge of panel 12 is a longitudinal flange 24 offset from the panel base plane and sized to interfit in the channel 22 at the top of the next lower panel. Thus, flange 24 of panel 12 interfits the channel 22 of panel 16. Both channel 22 and flange 24 are continuous, members; the front leg 23 of U-shaped channel 22 bridges each of the many underlaps 27 present in the panel face at a step 25.

The interfit of channel 22 and flange 24 facilitates provision of a simulated shake array with random (a non-linear) butt lines. Any butt line can, of course, be built into the upper shake course, since the intersection between the butt end of the upper course shakes and the top edges of the lower course shakes are all built into the same panel. Desirably, then, a random butt line is provided for the upper course shakes as is illustrated. However, a random butt line is also built into the shakes of the lower course. Overlaps here are somewhat undesirable, and are avoided because in the instance of lowest course shakes, overlaps would constitute panel-to-panel overlaps creating unnecessary complications, perhaps hindering facile placement of the panels on a structure. Instead, horizontal underlaps provide the random butt line of the lowest course shakes.

Figure 3:
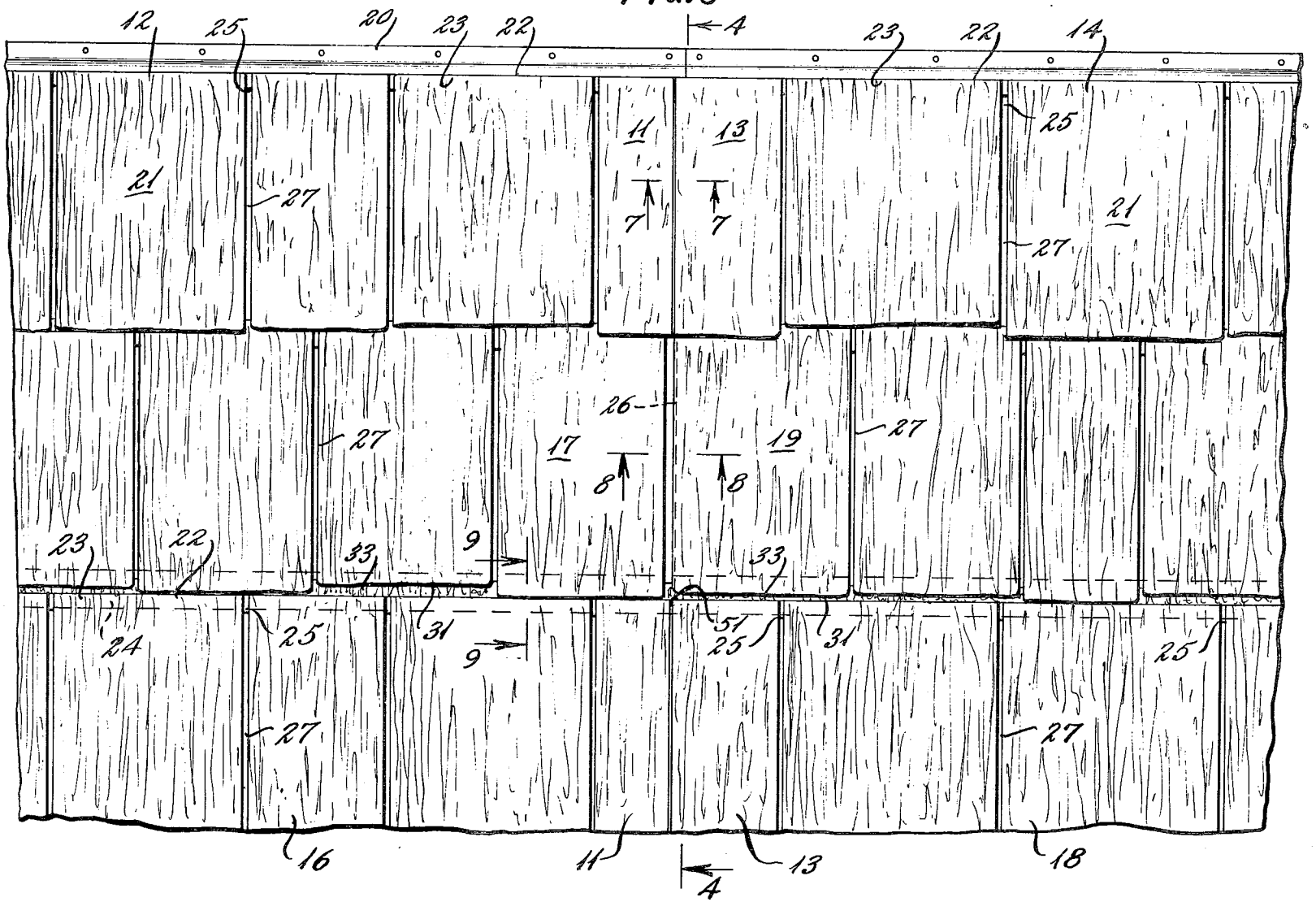
FIG. 3 is an enlarged fragmentary view of the assembly of several panels in a four-corner interfit assembly mode.

According to a preferred mode of panel, the top edge of the shakes in the uppermost course are in line, forming the top edge of upper channel leg 23. The bottom edge of some shakes in the lowermost course, e.g. shake 17, may abut (but should not overlap) this channel edge on the subadjacent panel (e.g., the top edge of shake 11, as illustrated in FIG. 3). At other shakes, a horizontal underlap 41 is present, the horizontal underlap apparently exposing some underlying surface to view. Where the underlap is relatively great, as in the existence of underlap 31, the panel material may have graining 33 thereon so as to enhance the appearance of a wood surface being exposed to view.

Figure 11:
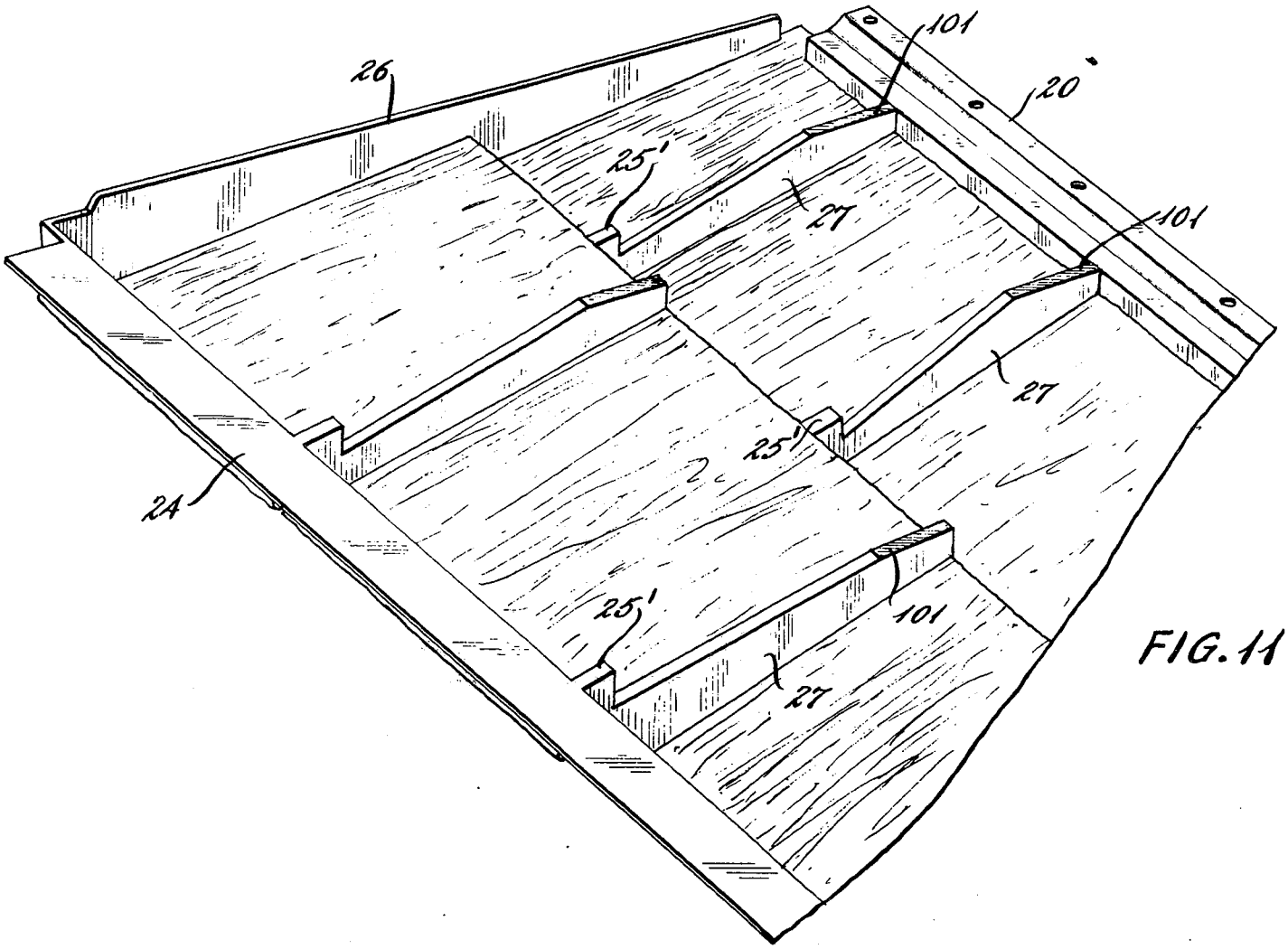
FIG. 11 is an enlarged fragmentary back face perspective view of the simulated shake panel.

As may be seen in FIG. 11, use of horizontal underlaps fits well with the flange 24 in channel 22 panel interfit structure. The areas of underlaps 31 constitute simply an (upward) extension of flange 24.

The side marginal panel edges also contain interfitting means. One side marginal edge of the panel (See FIGS. 5–8) e.g. the left-hand side edge, terminates in a downwardly extending tongue 26. The other side marginal edge terminates in a channel 28 as deep as the shake-to-shake underlaps. As may be seen in the preferred mode of panel illustrated in the drawing, notably in FIG. 3, the simulated shakes 13 and 19, (the shakes at the left hand corner of panel 14) extend to the very marginal edge of the panel; their edges are in line. At the other side edge e.g. the right-hand side, the upper course shake 11 on panel 13 terminates closer to the edge the distance of a typical shake-to-shake underlap, and at a narrow portion 41 of channel 28, a portion barely wide enough to contain tongue 26 of the adjacent panel 14. The greater spacing of the lower edge shake 17 from the panel edge is taken up by providing there a broad channel portion 43. In consequence, when panels 12 and 14 are joined side by side with tongue 26 interengaged in narrow portion 41 of channel 28, shakes 11 and 13 merge into what looks like a single cracked shake. As may be seen in FIG. 3, shakes 11 and 13 are narrow, half-shakes so to speak, so that the joint of side-by-side interengaged panels provides the appearance of a full-sized but cracked shake.

In contrast, the lower broader portion 43 of channel 28 in the region in panel 12 of end shake 17 is relatively wide, being in fact wider than portion 41 by about the space of a typical vertical shake-to-shake underlap. When the panels are interfitted side by side with the left-hand side tongue 26 disposed in right-hand side channel 28, tongue 26 still seats adjacent the far channel wall 29 (which constitutes the actual side edge of the panel), the base of the lower portion 43 of U-shaped channel 28 is therefore exposed to view, appearing as simply another shake-to-shake underlap. Here the full shake underlap depth conceals its true nature as the panel-to-panel juncture, appearing rather to be another intra-panel shake-to-shake underlap.

As can be seen in FIG. 3, the panels are interchangeable rectangular members with linear top, bottom and side edges which can interfit either in a four-corner configuration (as is illustrated in FIG. 3) or staggered horizontally in the successive panel courses. The four panel corners allow for the overlap involved in interfitting side edge tongue 26 into side channel 28 and bottom edge flange 24 into top channel 22. On one side, e.g. the right-hand side of the panel, nailing strip 20 and channel 22 extend clear to the panel side edge. At the left-hand marginal edge of the panel 12, both flange 24 and nailing strip 20 terminate short of the side edge, a distance equal to the panel-to-panel overlap which fits side edge tongue 26 into side channel 28. Therefore, each course of panels is completely independent of the next lower and the next higher course. The nailing strip 20 extends the length of the panel course. So too does the bottom edge flange 24, permitting thereby an offset or staggered relationship of the individual panels in successive panel courses. In practice, the four-corner interfit illustrated in FIG. 3 will be employed rarely. The lowest or starting panel course interfits with a starter strip 103, the structure of starter strip 103 being illustrated in FIGS. 2 and 10.

An advantageous material-saving feature of the present panels has been created by the above described interfit of channel 22 and tongue 24. Mention has been made that successive panel courses may be staggered in almost a random fashion. The installer may start with a panel placed at a lower corner of building structure 10, and nail an entire course of panels, interfitted side-edge to side-edge until the far corner of the structure is reached. Normally a whole panel wil simply not fit exactly. The installer may cut the last panel to size, then employ the leftover segment to start the next course of panels. Material wastage is virtually nil and successive panel courses become staggered almost in a random fashion. In most instances, no two courses would commence with the same length of panel fragment.

Figure 10:
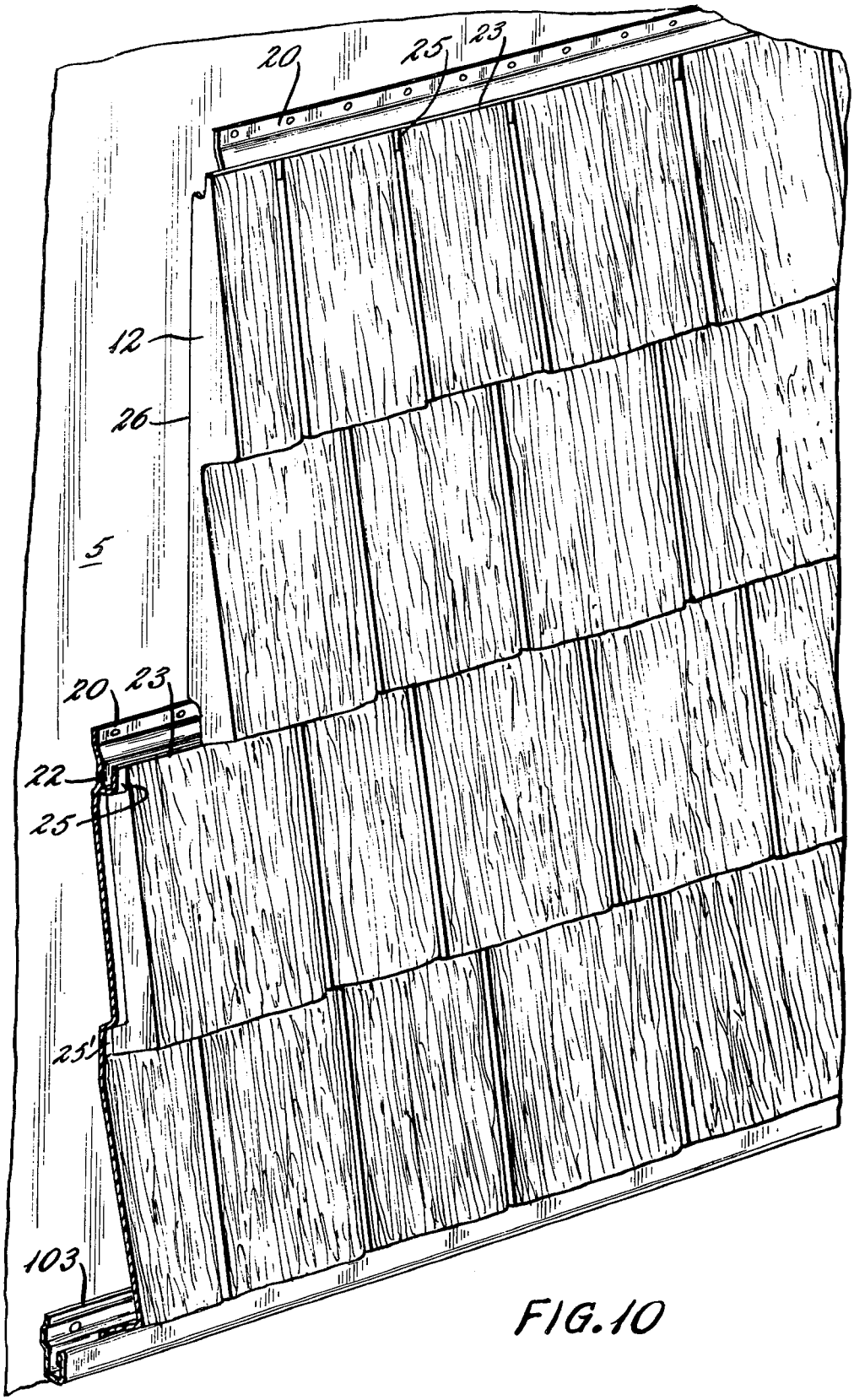
FIG. 10 is a fragmentary perspective front face view of two simulated shake panels joined top-to-bottom.

On the other hand, the panels are intended for exact side-to-side alignment (otherwise half-shakes 11 and 12 will not mate). The side marginal channel 28 and tongue 26 are related to such alignment and also to the shake simulation. Thus the depth of channel 28 is that of the simulated shake underlaps and the channel merges top and bottom into nailing strip 20 and flange 24 respectively. The far channel wall 29 is shorter, terminating top and bottom within the confines of simulated shakes 13 and 19, so that the channel wall may be concealed behind the shakes. As may be seen in FIG. 5, the top terminus of far channel wall 29 is short of the horizontal (top edge) channel 22. From there, channel wall 29 extends to a terminus spaced well above flange 24, enough so that the lower corner of simulated shake 19 clears and conceals channel wall 29 from view (as may be seen in FIG. 3). Side edge tongue 26 extends then from the base of shake 19 to adjacent top edge of half-shake 13. FIG. 10 illustrates how appropriate cutouts are provided at the corners to allow panels to interfit in staggered course relationship.

Thus the panel-to-panel joints involve overlapped, interfitted concealed junctures, save only the virtually imperceptible (vertical) junctures 51 at the corners. A close fit is made possible by the replicated identity of the basic panel, and juncture 51 may be quite tight, even in the four-corner, non-staggered panel course arrangement illustrated by FIG. 3. In addition, the open juncture 51 is offset from vertical channel 28, so that water is not directed to juncture 51. A sealant may, of course, be applied to junctures 51.

Figure 4:
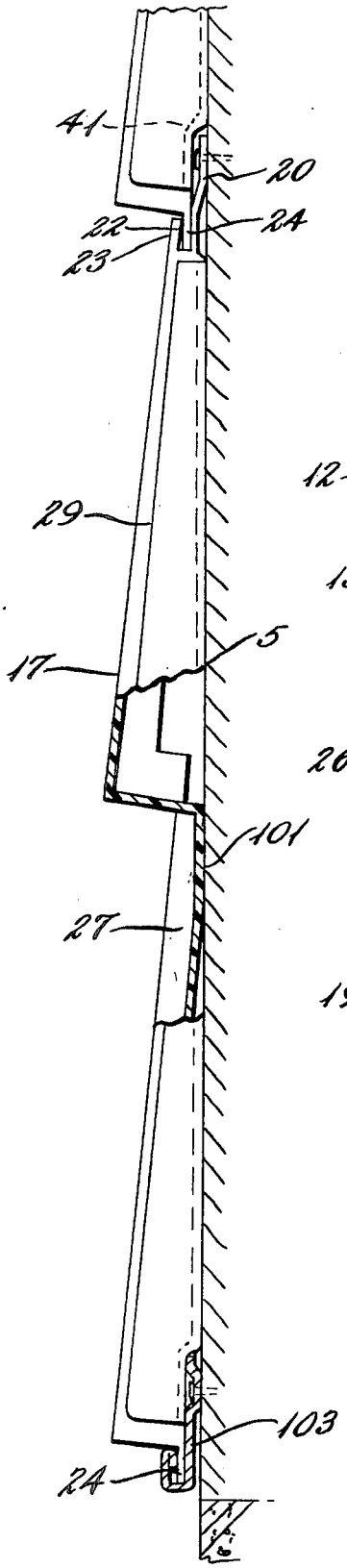
FIG. 4 is a section on the line 4—4 of FIG. 3.
Figure 5:
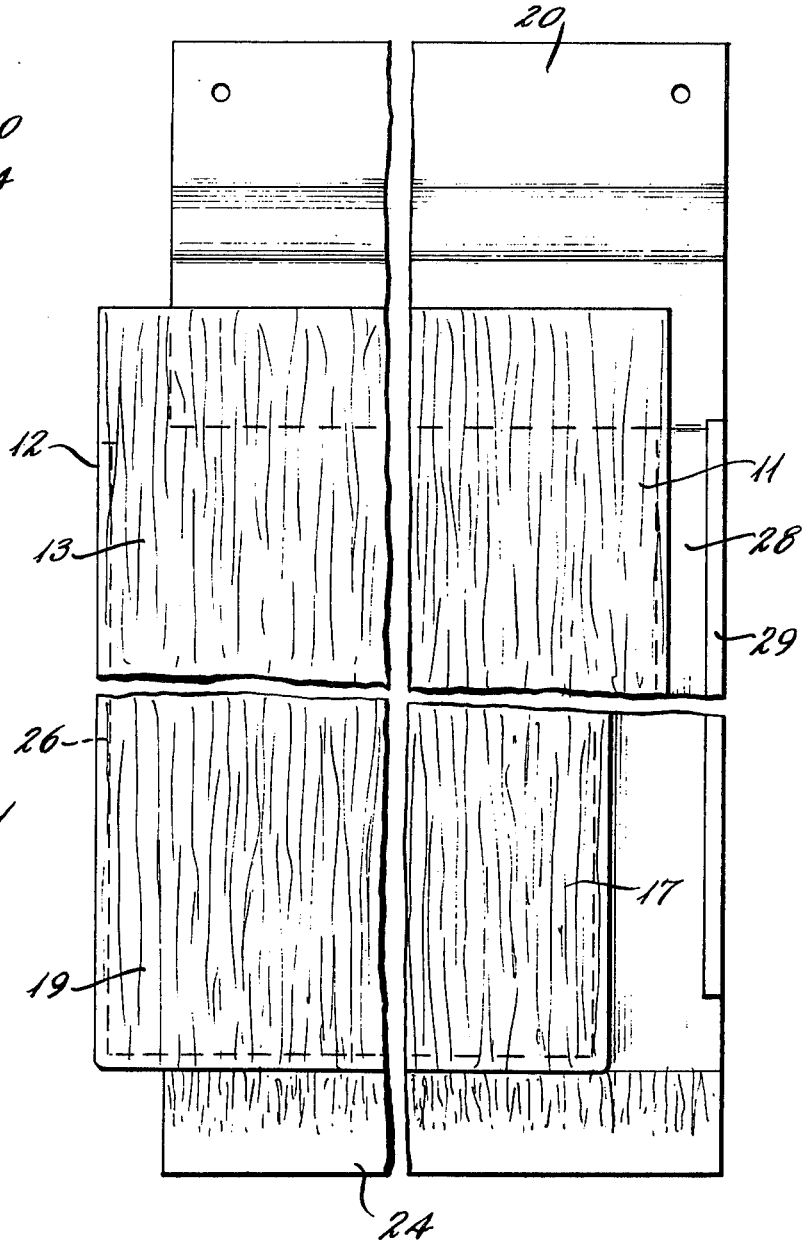
FIG. 5 is an enlarged fragmentary plan view of a single simulated shake panel.
Figure 6:
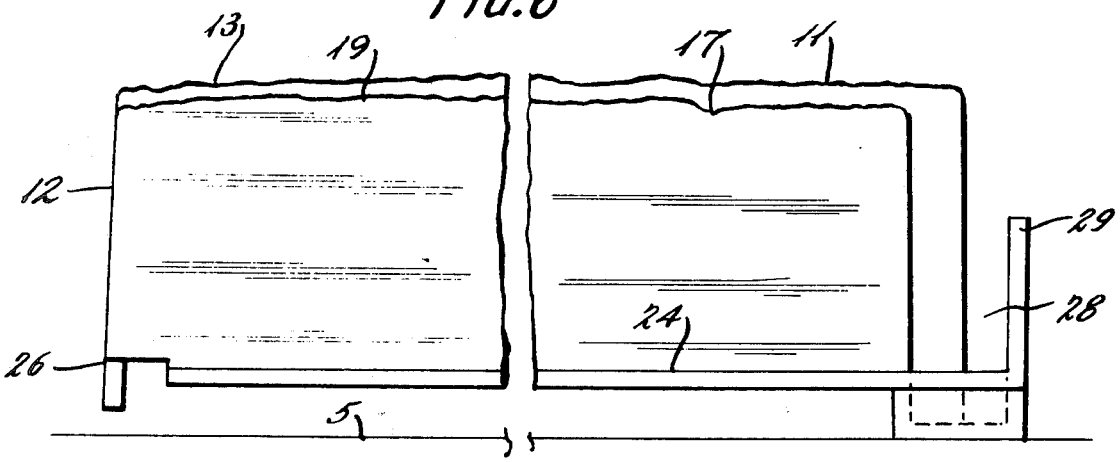
FIG. 6 is an enlarged fragmentary end view of the simulated shake panel of FIG. 5 looking up.
Figure 7:
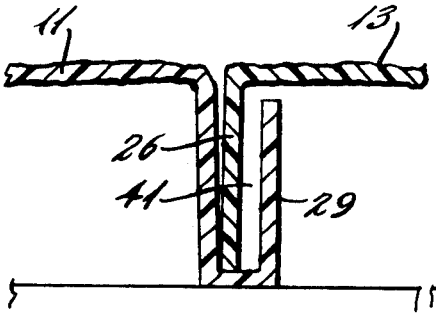
FIG. 7 is a section on the line 7—7 of FIG. 3.
Figure 8:
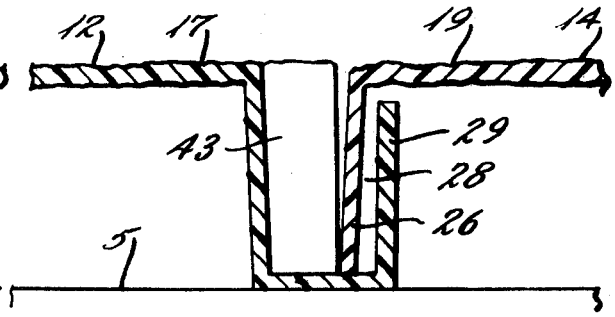
FIG. 8 is a section on the line 8—8 of FIG. 3.
Figure 9:
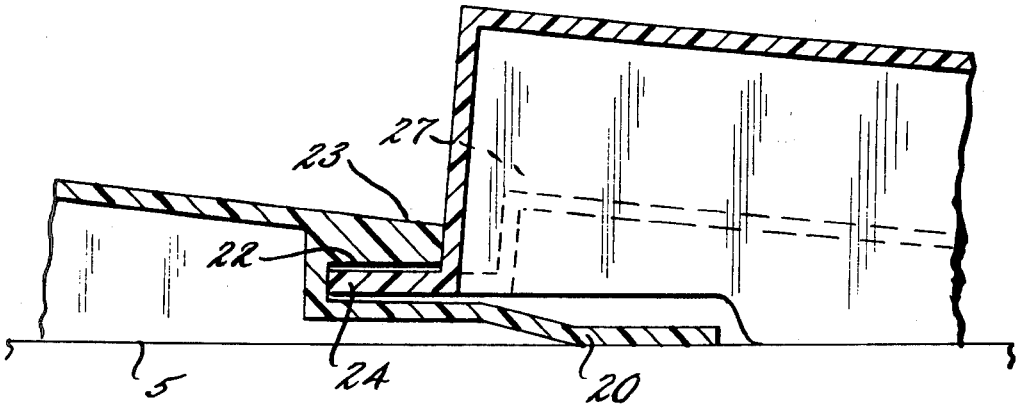
FIG. 9 is a section on the line 9—9 of FIG. 3.

Allusion has been made repeatedly that the simulated shake panel of the present invention combines good shake simulation with sound building practices. FIGS. 4, 9 and 10 illustrate how the shake faces stand out in relief from the structure wall. Yet nailing strip 20 is flush to the wall 5; flange 24 is offset relative to wall 5 so as to fit into channel 22. The base of channel 28 is flush against wall 5. Accordingly, the entire periphery of each panel seats directly or indirectly on the wall or roof. In addition, the shake-to-shake vertical underlaps are each made deep enough to create significant panel contact with the structure wall or roof.

In the underside view of the panel shown by FIG. 11, shading has been provided to show those portions of the panel in the wall surface contact plane, or base plane of the panel. The shaded areas constitute the multiplicity of internal support surfaces 101 provided within the vertical shake-to-shake underlaps. Each support surface is within a few inches, e.g. 5–10 inches, of a like support surface. Accordingly, the panel can safely bear moderate loads, including notably the weight of a person standing on the panel. For roofing applications, such a load-carrying capacity is important. Workmen, even the homeowner, may on occasion be required to stand or walk on a roof covered by the panels.

Provision of internal support surfaces 101 makes feasible relatively large panels, e.g. 18 inches by 60 inches for the exemplary panel of two ten-shake courses. Panels may now be as large and heavy as the installation workmen can handle expeditiously.

Related to the relatively large size of the panels is a separate stiffening expedient built into the vertical shake-to-shake underlaps, the stiffening expedient being best seen in FIGS. 10 and 11. Each vertical underlap 27 has therein an upper step 25 which forms part of channel leg 23, and a lower step 25' which seems to be the edge of a hidden shake. Presence of these steps, particularly lower steps 25', enhances rigidity of the panel.

The support and stiffening features are completely independent of the exact shake simulation on the panel face, allowing thereby freedom to mold different shake simulation arrays on panels which are interchangeable.

A structure 10 sheathed and roofed with shakes, simulated or natural, will frequently be finished off with shake corners and ridge caps, and use of simulated equivalents thereof as required is contemplated with the simulated shake panels 12. The drawings illustrate preferred modes of ridge cap 40 and corner pieces 70, these modes being particularly adapted for installation along with the already described simulated shake panels.

The cap 40 is an angled member having a central ridge 42 thereon. A multiplicity of simulated, apparently overlapped shakes (as for example, shakes 41,43,45) extend in a row on each side of the ridge line. A roof ridge or hip is topped by as many ridge caps 40 abutted, angled end to angled end as is needed, as is shown in FIG. 1. At one angled end, each ridge cap 40 is provided with a nailing strip 44 which forms the base leg of a U-shaped channel 46. The other (upper) leg of channel 46 forms the terminal edge of a simulated shake e.g. shake 45. Correspondingly, the opposing angled edge of ridge cap 40 is provided with a flange 48 sized and positioned to interfit the channel 46 of an abutting ridge cap. Except to close examination, the joint between adjacent ridge caps, namely the juncture of shakes 41,45 is indistinguishable from the shake-to-shake junctures built into cap member 42.

Figure 12:
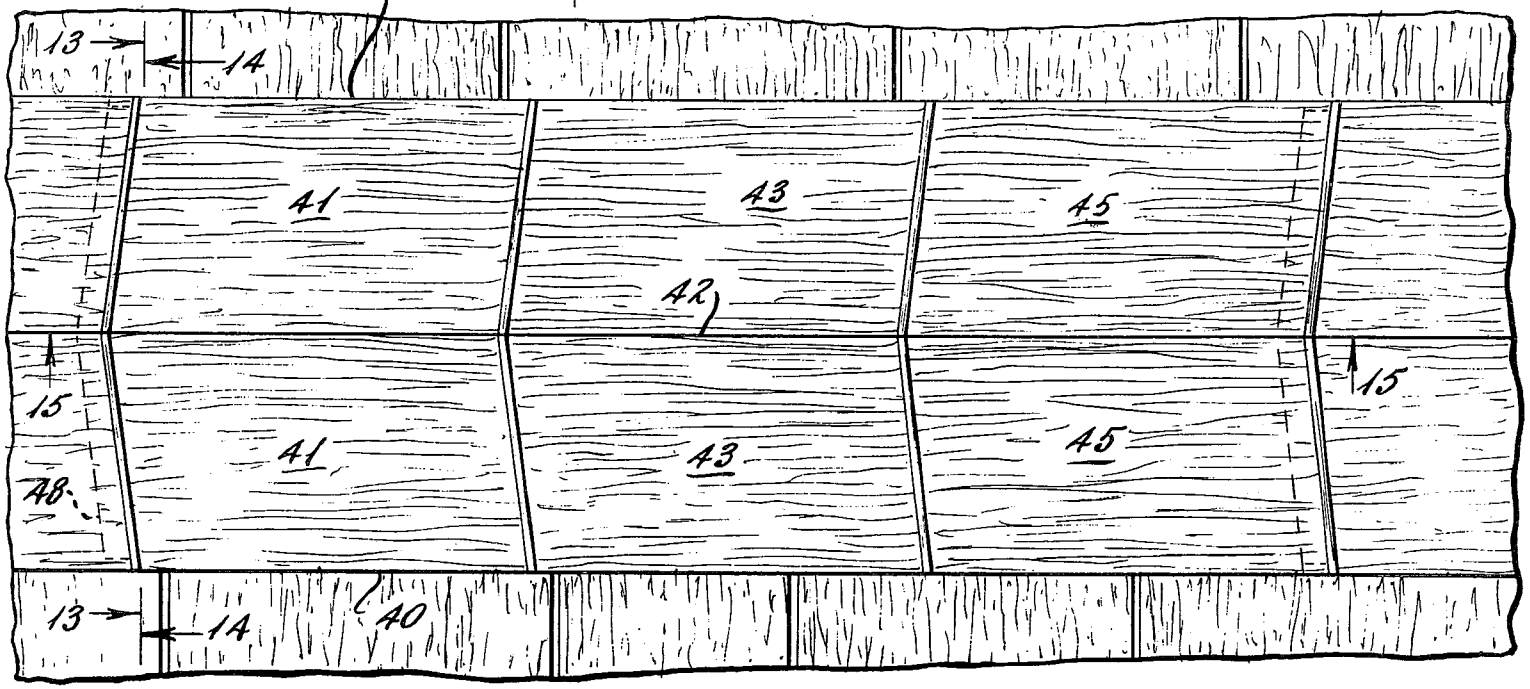
FIG. 12 is a plan view of a ridge cap.
Figure 14:
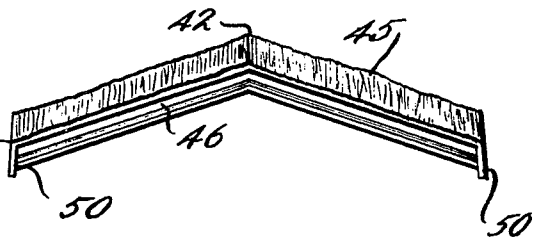
FIG. 14 is a transverse section on the line 14—14 of FIG. 12, illustrating the opposite end of the ridge cap in elevation.
Figure 13:
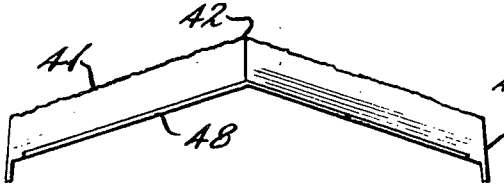
FIG. 13 is a transverse section on the line 13—13 of FIG. 12, illustrating one end of the ridge cap in elevation.
Figure 15:
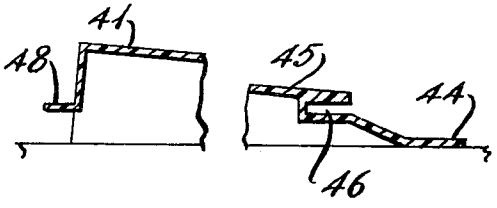
FIG. 15 is a longitudinal section on the line 15—15 of FIG. 12, broken away.

Each of the longitudinal side edges of cap member 40 terminate in a downwardly extending tongue 50. As may be seen in FIG. 12, ridge cap 40 overlaps panels 12 and tongue 50 rests on the overlapped panel, the overlap and presence of tongue 50 serving to seal off underside of ridge cap member 40 from wind and rain.

Figure 16:
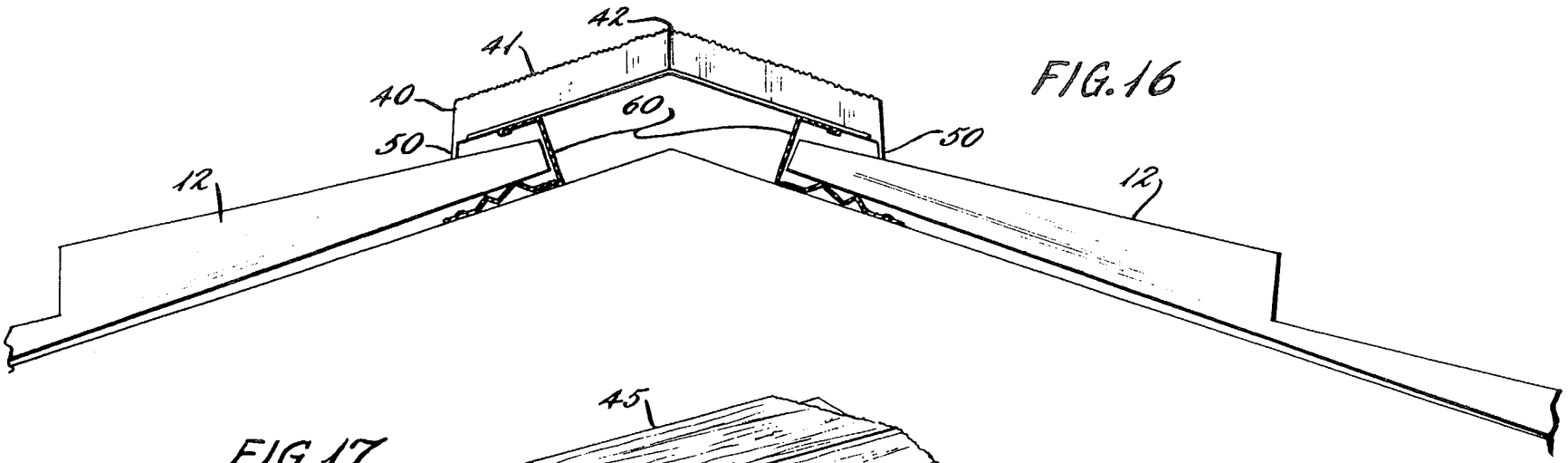
FIG. 16 is a section on the line 16—16 of FIG. 12.
Figure 17:
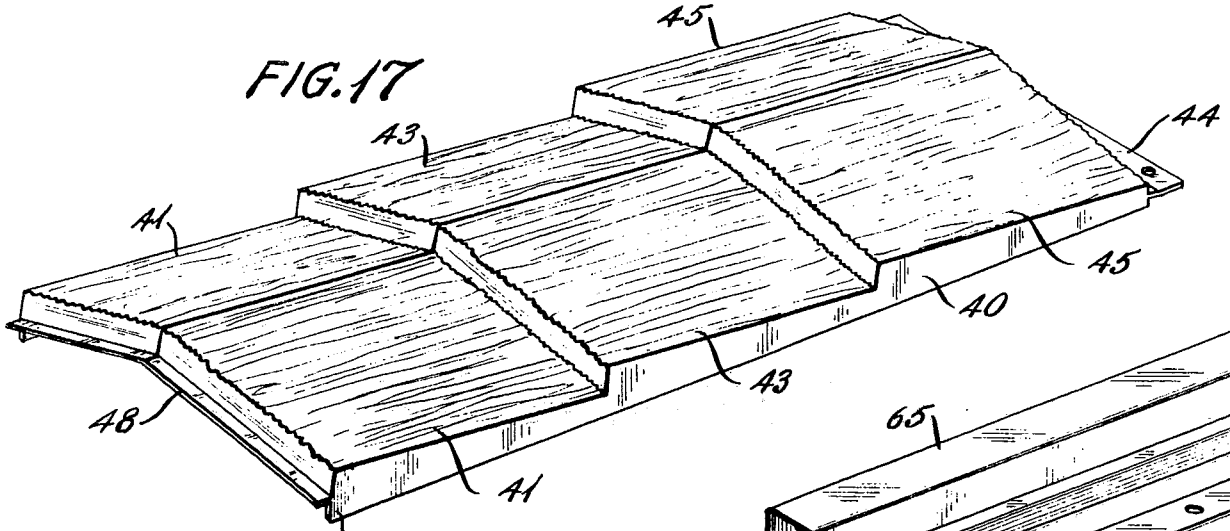
FIG. 17 is a perspective view of the ridge cap member of the present invention.
Figure 18:
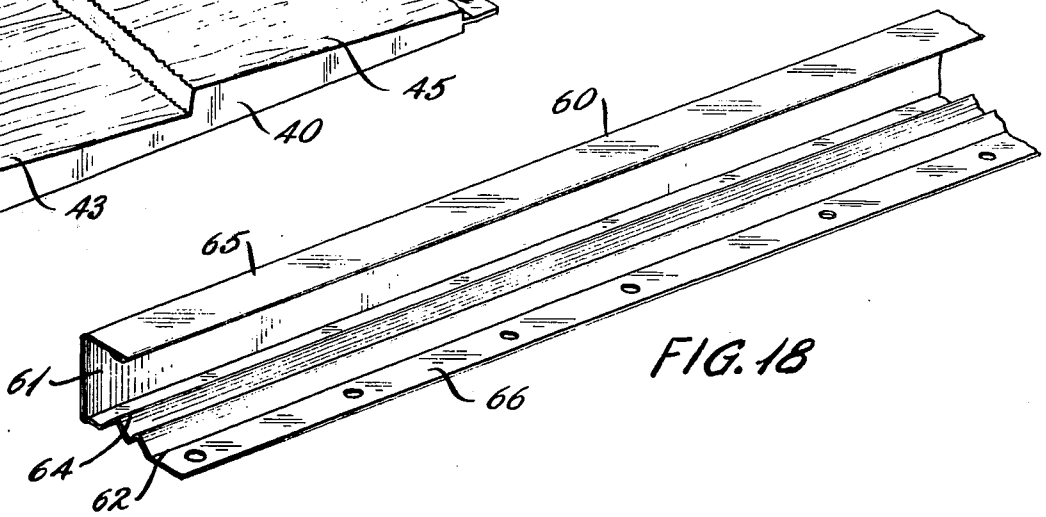
FIG. 18 is a perspective view of the gable strip member.

However, where wind-driven rain may easily be forced under tongue 50, in hip roofs for example, a gable strip (preferably metallic) may be interposed between ridge cap 40 and the topmost edge of panels 12. A preferred mode of gable strip 60 is illustrated in FIG. 18. The gable strip 60 comprises an elongated deformed U-shaped channel 61 wherein one leg 62 of the channel has an inward bend 64 directed toward the other leg 65. A nailing tab 66 extends from the deformed or bent leg. This gable strip is nailed to the roof parallel to the hip or ridge, with its opening away from the ridge or hip as shown in FIG. 16. After the gable strip 60 is installed, the cut-off edge of a panel 12 enters channel 61 to seat on bend 64 while the underside of ridge cap 40 rests on the channel leg 65 of gable strip 60.

Any water driven under tongue 50 on cap member 40 will pass beneath channel leg 65, then around the edge of panel 12, thereafter be caught in the rain trap formed inside gable strip 60 by bend 64 and flow off the roof.

FIG. 16 illustrates the expectation that the topmost simulated shake panel will have been trimmed to fit the actual space left for the top course of panels (also, the ridge cap nailing tab 44 will be trimmed to allow for the gable strip). FIG. 16 illustrates how the space directly beneath cap 42 is open, ventilating the roof. FIG. 16 also illustrates a 150° cap member and the roof ridge to which such a cap member is adapted. For hip roofs in particular, cap members with other angles, e.g. 120°, may be provided.

Referring now to FIGS. 19–26, wherein is illustrated the simulated shake corner member of the present invention, it may be seen that the outside face of corner piece or member 70 simulates two shakes 71,73 nailed or otherwise mitre attached at about 90°, one to the other. As may be seen in FIGS. 19 and 20, corner piece 70 is formed with a horizontal base 72 approximating in size the depth of a natural shake. A vertical lip 74 upstands from the inside edge of base 72, at the inside corner edge portion thereof. Lip 74 is intended as a locking element for securing corner to corner in overlapping relationship. At the top of corner 70 is a nailing tab 76 which constitutes an extension of the simulated shake faces 71,73. If desired, nail holes may be provided (as shown) adjacent the top edge of nailing tab 76. The face of nailing tab 76 has a nose-like member 78 projecting forward from the planes of shake faces 71,73 (as shown in FIG. 23) leaving a slot receptor 80 formed between the base of nose 78 and planes of the nailing tab 76.

The corners 70 can be interfitted butt-end to head-end with lip 74 received inside slot receptor 80, as is illustrated in FIG. 21. To facilitate the shake simulation stacked on interfit of successive corners, the shake faces 71,73 are angled forward (from top to bottom) so that at the bottom of a corner 70, its lip 74 can enter slot receptor 80 of the next lower corner, while the upper end of nailing tab 76 seats against the wall surfaces and can be nailed thereto. Since stress may occur at the region of slot receptor 80, strengthening ribs 82 may be provided on the inside wall of the simulated shake corner 70 adjacent the wall area weakened by presence of nose 78 and receptor slot 80.

As may be seen in FIGS. 19 and 20, the corners 70 are adapted to fit in a vertical stack, one on top of the other, with the shake faces 71,73 overlapping the side edges of the adjacent simulated shake panels. The length of shake faces 71,73 corresponds to the length of the simulated shakes on the panel face so that the length of two corners head-end to butt-end correspond to the full panel height. Some leeway for fitting corner to panel exists in the fit of lip 74 into slot receptor 80; the length of lip 74 is enough to interengage with slot receptor 80 even though the corner may have to be moved up or down (e.g. ½ inch vertically) for the best fit with the adjacent panel.

However, more is required than leeway. Desirably, the base 72 of corner 70 is fitted under the edge of the simulated shakes overlapped by one side of corner 70, as for example, shakes 91 and 95. Due to variations in shake-butt elevation built into panel 10 (to provide the desired random shake butt line) both sides of the corner 70, as for example, at shakes 93 and 97, will almost never be at the same elevation relative to the overlapped panel shakes, leaving potentially a gap 99 between the shake bottom and the base 72 of corner 70. To close the gap, a skirt 84 (shown on FIG. 26) is provided at each far edge of the corner at the butt end thereof, the skirt upstanding essentially vertically from base 72, and angling in from the shake faces 71,73 to better merge into the face of panel 10. The skirts 84 are provided as the means for closing up the differences in elevation at a corner, as with simulated shakes 93 and 95.

To fit a corner 70 to the overlapped shakes on each side of the corner, the skirt 84 on that side of corner 70, which overlaps the lower shake, e.g. shake 91 or 95, is snipped completely away. On the other side of the corner, e.g. at shake 93 or 97, enough of the skirt 84 is retained (not snipped away) to close up the distance of the gap between the bottom of the corner and the edge of the shake. The skirt height corresponds to the greatest gap 99 that can be expected, namely the spread in the butt line between the lowest shake and the highest shake. On rare occasions, the simulated shake configuration on panel 12 may create interference with the desired tight fit of a particular corner, as may be the instance with shake 91 (In FIG. 19). In such instance, the top of the shake face on corner member 70 can and should be trimmed to improve the fit of the corner member 70 with the overlapped shake panel.

What is claimed:

1. A simulated shake panel characterized by the random appearance of individual shakes comprising a board-shaped panel member having:

means at the top, bottom and side marginal edges of said panel member for interfitting successive like panels top to bottom and side to side;

nailing means for securing said panel to a building, said nailing means being concealed when successive like panels are interfitted;

the front face of said panel comprising a plurality of simulated side by side underlapped randomly sized shakes in at least two courses thereof, each shake course having a random butt line, said shakes being disposed in top and bottom overlapping and underlapping relation, apparently exposing an underlying wall surface to view at the side by side and top and bottom underlaps, the end shakes in one course being half-shakes and the end shakes in a second course being full shakes with the terminus of at least one of the end full shakes in said second course being spaced inward on the panel face from the terminus of the adjacent half-shake of said first course, whereby panels joined edge create in said one course the simulation of a cracked full shake spanning the side edge joint masking same in the said one course, and leaving a full side-by-side shake underlap appearance at the side edge joint of said second course, said underlap being visually the same as the underlapped intra-panel side-by-side shakes.

2. A simulated shake panel characterized by the random appearance of individual shakes comprising a board-shaped panel member having:

an upwardly extending nailing tab forming the longitudinal top marginal edge thereof, said tab being the base leg of an upwardly open U-shaped channel formed at the top of said panel;

a longitudinally extending lower flange forming the lower marginal edge of said panel, said lower flange being sized and offset to interfit the U-shaped channel whereby successive vertical courses of panel can interfit flange into U-shaped channel;

the front face of said panel comprising a plurality of simulated side-by-side underlapped randomly sized shakes in at least two courses thereof, said shakes being disposed in top and bottom overlapping and underlapping relation apparently exposing an underlying wall surface to view at the side-by-side and top and bottom underlaps, each shake course having a random butt line;

the shake top edges of the uppermost course of shakes being in line, and the butt edges of the lowermost course of shakes being staggered in random fashion with the lowest of the shake butt edges adapted to abut the top shake edges of a subadjacent panel and all other shake butt edges leaving an underlap at the butt line juncture to a subadjacent panel exposing apparently thereby an underlying wall surface, such exposed underlap surface being an extension of the lower flange upward to the shake butt edge.

3. The simulated shake panel according to claim 2 wherein exposed underlap surface areas beneath the lower course shake butt edges are grained.

4. A simulated shake panel characterized by the random appearance of individual shakes comprising a board-shaped panel member having:

an upwardly extending nailing tab forming the longitudinal top marginal edge thereof, said tab being the base leg of an upwardly open U-shaped channel formed at the top of said panel;

a longitudinally extending lower flange forming the lower marginal edge of said panel, said lower flange being sized and offset to interfit the U-shaped channel whereby successive vertical courses of panel can interfit flange into U-shaped channel;

an outwardly open U-shaped channel forming one side marginal edge of said panel;

and an inwardly extending tongue forming theother side of said panel, said tongue and side edge channel being sized to interfit tongue into U-shaped channel, whereby successive panels can interfit side by side, said marginal flange, tongue and channels being adapted both for four-corner interfitting and for staggered course interfitting;

the front face of said panel comprising a plurality of simulated side by side underlapped randomly sized shakes in at least two courses thereof, each shake course having a random butt line, said shakes being disposed in top and bottom overlapping and underlapping relation, apparently exposing an underlying wall surface to view at the side by side and top and bottom underlaps, the end shakes in one course being half-shakes and the end shakes in a second course being full shakes with the terminus of at least one of the end full shakes in said second course being spaced inward on the panel face from the terminus of the adjacent half-shake of said first course, whereby panels joined edge to edge create in said one course a cracked full shake spanning the panel to panel side edge joint masking same in the said one course and almost sealing the side U-shaped channel and whereby a full side-by-side shake underlap appearance is provided by the side edge joint at said second course, said underlap being visually the same as the underlapped intra-panel side-by-side shakes.

5. The panel of claim 4 wherein the horizontal marginal channel and flange each extend from the side edge channel to a terminus near the side edge having the tongue thereat spaced apart therefrom, the extent to which tongue and side channel overlap side-by-side panels.

6. The panel of claim 5 wherein the marginal wall of the side edge channel and the side edge tongue terminate top and bottom at locations inwardly of the horizontal flange and U-shaped channel.

* * * * *